US007316562B2

(12) United States Patent
Trefall et al.

(10) Patent No.: US 7,316,562 B2
(45) Date of Patent: Jan. 8, 2008

(54) METHOD AND SYSTEM TO IGNITE INFLAMMABLE FLUIDS

(75) Inventors: Reidar Trefall, Radal (NO); Jon-Roald Fonnes, Sandsli (NO); Rune Totland, Sandsli (NO)

(73) Assignee: ABB Gas Technology AS, Bergen (NO)

( * ) Notice: Subject to any disclaimer, the term of this patent is extended or adjusted under 35 U.S.C. 154(b) by 0 days.

(21) Appl. No.: 10/398,013

(22) PCT Filed: Oct. 2, 2001

(86) PCT No.: PCT/NO01/00404

§ 371 (c)(1),
(2), (4) Date: Jul. 21, 2003

(87) PCT Pub. No.: WO02/37029

PCT Pub. Date: May 10, 2002

(65) Prior Publication Data

US 2004/0043344 A1 Mar. 4, 2004

(30) Foreign Application Priority Data

Oct. 2, 2000 (NO) ..... 20004945

(51) Int. Cl.

| | |
|---|---|
| ***F23G 7/08*** | (2006.01) |
| ***F23N 5/20*** | (2006.01) |
| ***F24C 19/12*** | (2006.01) |
| ***F42B 30/00*** | (2006.01) |

(52) U.S. Cl. ..... 431/202; 431/72; 102/202.5; 102/206

(58) Field of Classification Search ..... 431/6, 431/5, 202, 91, 269, 72, 28; 102/335, 336, 102/431, 472, 202.5, 206, 200; 89/1.816
See application file for complete search history.

(56) References Cited

U.S. PATENT DOCUMENTS 1,739,921 A * 12/1929 Schuler et al. ..... 102/209

(Continued)

FOREIGN PATENT DOCUMENTS

CA 2162934 A1 * 5/1997

(Continued)

*Primary Examiner*—Josiah C. Cocks
(74) *Attorney, Agent, or Firm*—Francis C. Hand; Carella, Byrne, Bain et al.

(57) ABSTRACT

A method is described for igniting discharges of inflammable fluids, such as gases which are discharged in a flare, where an ignition pellet is set in motion towards the fluid discharge along a conducting body and made to detonate in or near the fluid discharge, so that the fluid is ignited. The invention is characterised in that the device, during its travel towards the fluid discharge, goes through detonation generating events in which an electronic system registers several subsequent sequences, such as: 1) a sequence in which a control circuit (a system) is activated (switched on), 2) a sequence in which the device is activated as it passes, and registers a predetermined series of identical or different pulse influences, and 3) a sequence in which the device thereafter is made to detonate by a pulse influence which indicates that it has passed the conducting body towards the fluid discharge. A system for carrying out the method is also described.

6 Claims, 2 Drawing Sheets

U.S. PATENT DOCUMENTS 3,048,085 A * 8/1962 Dickey ..... 102/342
4,431,402 A * 2/1984 Hamilton ..... 431/202
4,449,920 A * 5/1984 Lerouge et al. ..... 431/91
4,750,424 A * 6/1988 Hau ..... 102/200
5,964,586 A * 10/1999 Odemark et al. ..... 431/202
6,247,412 B1 * 6/2001 Vornfett ..... 102/472

FOREIGN PATENT DOCUMENTS

WO WO 94/29648 A1 * 12/1994

* cited by examiner

METHOD AND SYSTEM TO IGNITE INFLAMMABLE FLUIDS

The present invention relates to a method and a system for the ignition of inflammable fluids, and in particular gases that flow out of a gas pipe in connection with a flare or a flare tower and the like, as described in the subsequent independent claims.

In more detail, the invention relates to a construction of an ignition pellet which leads to increased safety in connection with the activation and detonation of the ignition pellet.

The background to the invention is that one has a need for a safe ignition of a gas discharge, in connection with the production and refining of hydrocarbons (oil products), such as on oil production platforms and other sites where inflammable gases are handled.

Regarding the ignition itself, a number of solutions are previously known. Such solutions consist of the mixture of gas/air being ignited with the aid of a match, an electric spark, a pilot burner, or the like, or by a cloud of glowing particles being spread out in the inflammable gas so that the gas mixture ignites.

In ignition systems of the latter type, an ignition pellet is launched through a tube and made to detonate at the gas discharge to set up the mentioned cloud of sparks. The ignition pellet can be detonated in two ways. Either as it is described in Norwegian Patent application 932017, in that the ignition pellet hits against a solid body at the gas discharge site whereby the deformation or compression energy causes a detonator in the ignition pellet to detonate and spread out a cloud of sparks into the gas discharge and ignite it. Alternatively, the detonation can occur in that the ignition pellet contains an internal firing mechanism which is activated and which detonates after a given series of events, as described, for example, in Norwegian Patent NO 179 762.

In particular, the invention is concerned with the last described technology, in which the ignition device contains an internal firing mechanism which detonates an explosive charge.

The firing mechanism according to NO 179 762 is activated either by an electric pulse, or by means of a mechanical function. By activation/firing with an electric pulse, the ignition pellet receives electric energy during its movement towards the top of the flare in that it passes two contact points that shall provide the ignition pellet with an electric pulse.

The time period from the activation itself to the detonation must be adapted to the individual installation. One weakness with this kind of ignition pellet is that when it has been activated by passing the mentioned set of contacts, the ignition pellet will detonate after the given time has lapsed.

The mechanical ignition pellet which is produced and used, is activated by applying a actuating pressure of at least 4 bar for a given time interval. This is a disadvantage because the ignition pellet gains an unnecessary high speed or must be held back with a mechanical appliance.

After the ignition pellet has been activated, it will normally detonate at the exit-point of the firing tube. If the ignition pellet stops inside the tube, the ignition pellet must be localized and the tube section with the ignition pellet must be brought to a safe place for detonation.

Another disadvantage with this mechanical ignition pellet is that if it does not detonate, it is not possible to decide if it has been activated. A non-detonated ignition pellet which has been activated represents a great risk factor for the personnel who shall handle the waste after firing sequences.

The electrical activation method, as described in Norwegian Patent No. 179 762 assumes that the ignition pellet passes two electric contacts. This can be a source for the spark which demands special measures. One possibility is then to install these contacts so far up in the flare boom that they come outside zones in which explosions are dangerous. This will lead to problems with maintenance of the system.

It is an aim of the present invention to provide an ignition pellet which overcomes the described weaknesses.

The method according to the invention is characterised in that the ignition pellet comprises a detonator which detects a course of events of a given sequence of identical or different pulse influences to trigger the detonation.

The system according to the invention is characterised in that the ignition pellet comprises a circuit initiating the detonation and which in conjunction with the guiding/conducting body is arranged to detect a course of events of a given sequence of identical or different pulse influences to trigger the detonation.

The increased safety from using the invented ignition pellet lies in that the ignition pellet must go through a given number of pulse influences decided in advance before it is activated and detonates. Furthermore, one can take into account the speed of the ignition pellet and set an upper and a lower speed limit. In addition, one can set a time window for when the detonation can take place. Outside these limiting values, the ignition pellet will not be activated. The new ignition pellet is constructed so that all communication is wireless so that contact surfaces are avoided.

Before one goes into describing an actual embodiment of the invention with references to figures, a short description of the technical possibilities and principles which is the basis for the invention will be given below.

The Technology is Visualized as Follows:

The ignition pellet uses an electrically operated detonating charge for detonation of the detonating charge. Electricity for the ignition can come from a power source (for example a battery) which is included in the ignition pellet. The ignition pellet is activated by it <<seeing>> a series of events introduced in or on the conducting tube as it heads towards the gas mixture which is to be ignited. The ignition pellet is detonated by it <<seeing for itself>> when it exits from the conducting tube. This can be carried out with many types of sensors based on light, magnetism or sound. Alternatively, other types of sensors can be used.

The ignition pellet is switched off during transport and storage and cannot be switched on and be activated if it does not pass a minimum number of events during a short time window or time period. The control circuits and the sensors are encased so that the ignition pellet does not have external contact points.

When the control circuit has given a detonation pulse, it will remember the condition and it will be unable to give more detonation pulses. After the detonation pulse has been sent, the power source will be discharged. The ignition pellet will then be dead and can not be used again.

Description of the Functioning of an Electronic Ignition Pellet:

The technology is based on an ignition pellet being led through a tube in the same way as in a pneumatic despatch system. At the tube exit, the ignition pellet will detonate and emits a cloud of sparks. The shower of sparks shall ignite the gas which is in the area.

The ignition pellet can be sent out at different pressures and amounts of air, as the speed of the ignition pellet is not decisive for its function.

The invention shall now be explained in more detail with reference to the enclosed figures, in which.

Figure 4:
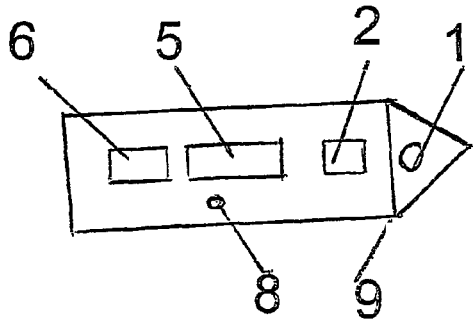

FIG. 4 schematically illustrates a pellet constructed in accordance with the invention.

Figure 1:
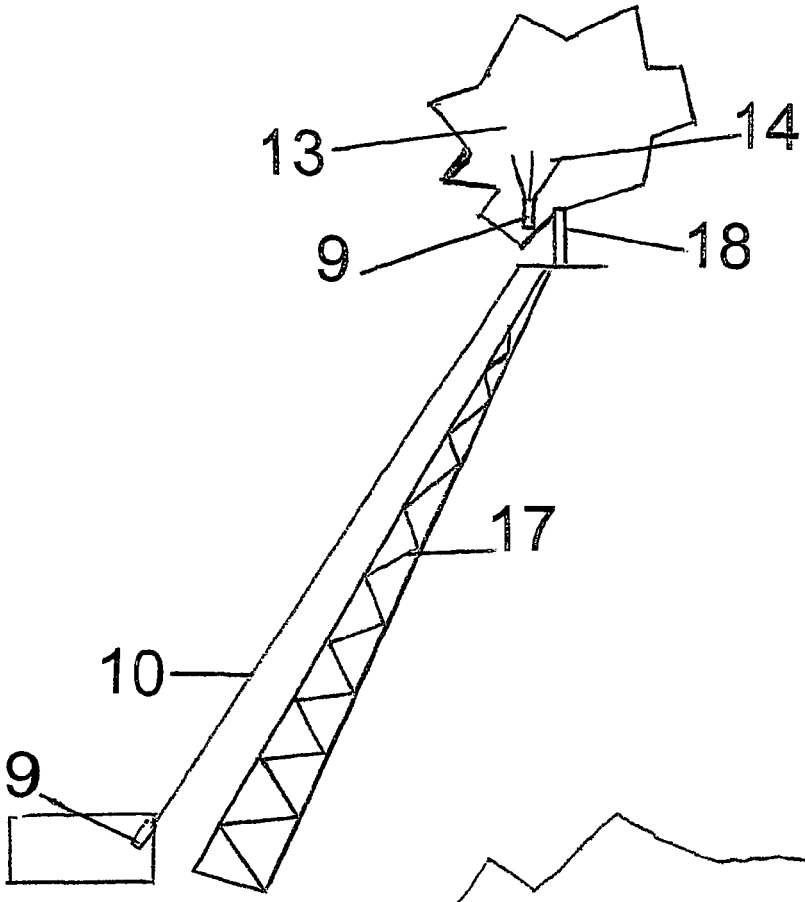
FIG. 1 shows a flare as an example of a gas discharge with a system for ignition of the gas in accordance with the present invention.

In FIG. 1, the principle for the ignition of a gas stream 13 in a flare 18 at the end of a flame tower 17 is shown in that a shower of sparks 14 from an ignition pellet 9 ignites the gas 13. At the end of the conducting tube 10, the ignition pellet explodes/detonates and creates a shower of sparks which ignites the gas stream 13.

In FIG. 4, the main components in the ignition pellet 9 are shown. The detonating charge 1 consists of an explosive material which creates the glowing particles for ignition of the gas. A detonation charge 2, which can be activated electrically, receives the detonation signal from the control circuit when the correct events are registered.

All electronics are operated by electricity from a power source 6 (such as a battery), and are encased in a plastic material 8 or protected in another way.

Figure 3:
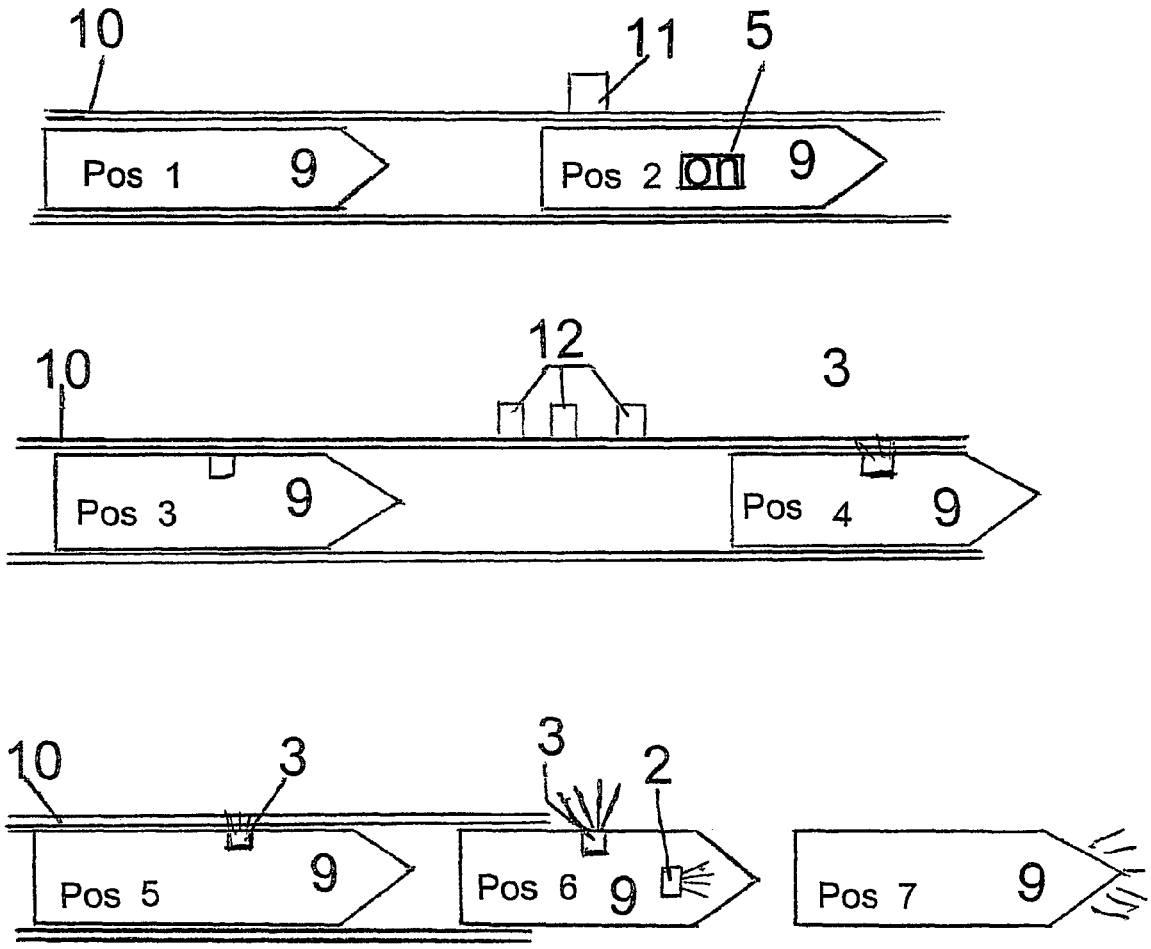
FIG. 3 shows the events-governed function sequence of the present invention.

FIG. 3 shows the function cycle of the ignition pellet 9. In position 1 (pos1), the control circuit is without electricity. In pos2 the control circuit gets activated (it is switched on) by an external signal, such as from a pulse generator 11. In pos3, the control circuit is active and is waiting for a series of events 12 (i.e. from a series of three pulse generators 12). If this series of events 12 is not detected within one time window (time period), the ignition pellet 9 will return to the conditions in pos1, in which the electric circuit is switched off. In pos4, the ignition pellet has detected the sequence of events 12 and starts the detection of the conducting tube (i.e. in the position in which the conducting tube 10 ends). In pos5, the ignition pellet will sense the tube wall until the ignition pellet leaves the conducting tube. In pos6, the ignition pellet 9 is on its way out of the conducting tube 10. The control circuit 5 will detect the missing tube and send the detonating signal to the detonating charge 2.

Figure 2:
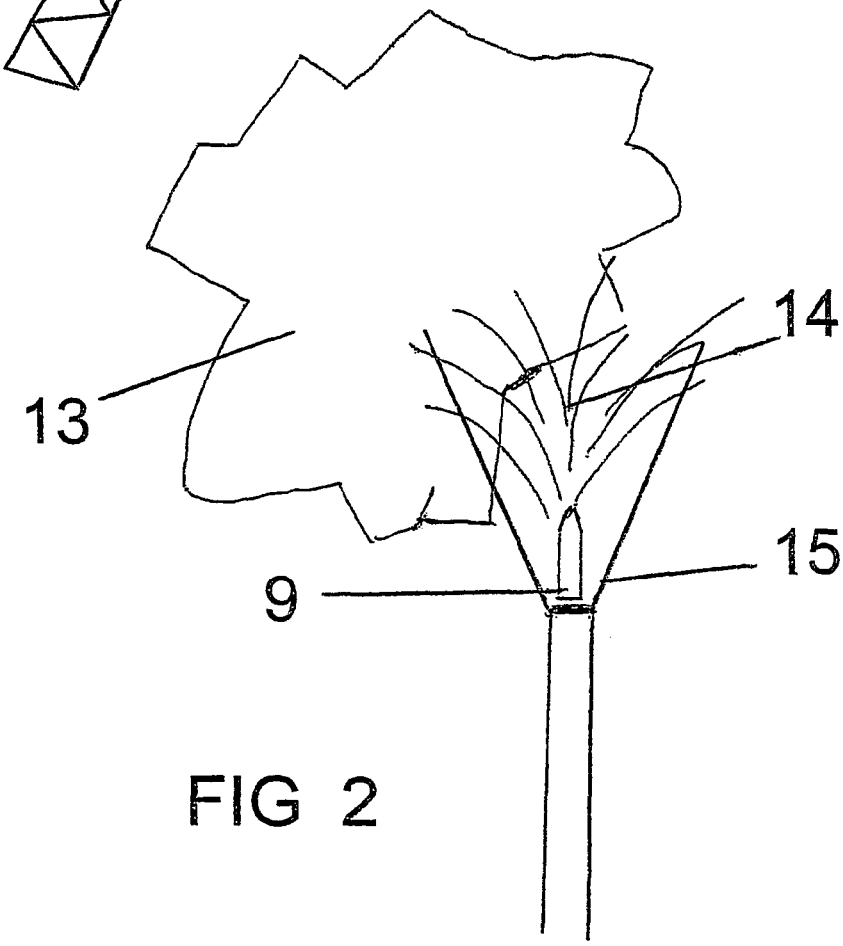
FIG. 2 illustrates an enlarged view of FIG. 1 showing an ignition pellet exiting a tube in accordance with the invention.

FIG. 2 shows that parts of the cloud of sparks 14 will mix with the gas stream 13 and ignite it.

Furthermore, with the present invention one has obtained a considerable improvement as the electronic ignition pellet is completely encased with no open contact surfaces. It must go through a series of events before it is activated, something which can occur far from the launch unit. The ignition pellet itself has a built-in mechanism to deactivate itself, and when the detonation sequence is started it will kill/break off its own supply of power. The risk for personnel which shall handle the remains is thereby considerably reduced, in addition to the handling and transport being safe. The ignition pellet can also be stopped inside the tube and removed from the tube, with no risk to personnel, after a pre-programmed time after firing.

Thus, the ignition pellet can be brought back to the launch unit and be launched again or be placed in a suitable waste container.

Another aim which is attained with the present invention is that the electronic ignition pellet can now be used on all flare applications without adaptation to each individual application being required.

Alternatives:

The external events with which the electronics of the ignition pellet can be operated according to, can for example consist of the following: Possible pulses which are set up in the form of a magnetic field, from a light source, a sound source, a heat source or a G-power sensor.

According to the invention, it is preferred that the electronic control circuit inside the ignition pellet is driven by a power source (a battery) inside the ignition pellet. However, one wishes that the circuit shall not be «live» before the ignition pellet is to be used, so that the battery is unnecessarily not drained for power. Therefore, the ignition pellet is initially switched off.

When the ignition pellet is to be used for real, an introductory switching-on step is performed in which the electronic circuit becomes live such that the sensing of the pulse events can start. The switching-on function can therefore be the first sequence of predetermined pulses which connects the battery to the circuit.

Thereafter follows the above mentioned pulse events which must come in a correct predetermined sequence so that a subsequent registration that the ignition pellet is out of the conducting tube shall lead to the ignition pellet being detonated.

Thereby, the ignition pellet goes through three steps:

1) it is switched on 2) it is activated 3) it is detonated.

Consequently, with this invention, a new method and a system with an ignition pellet is provided, which represents a great step forward in this technical area, with among other things, increased safety against ignition pellets detonating unintentionally.

Even if the invention is described with reference to actual, not-limiting solutions for the system, it will be obvious for one skilled in the art that the embodiments of the invention can be changed and modified in a number of different ways, without deviating from the idea of the invention as it is defined in the claims.

The invention claimed is:

1. A system for igniting discharges of inflammable fluids comprising a conducting tube;

a first pulse generator disposed along and externally of said tube;

a series of pulse generators disposed along and externally of said tube in spaced relation to said first pulse generator; and an ignition pellet for propulsion through said tube, said pellet including a detonation charge, a power source and a control circuit selectively connected electronically to said power source, said control circuit characterised in being activated in response to an activating signal from said first pulse generator to receive power from said power source, in remaining activated in response to sensing passage past said series of pulse generators and in delivering a detonating signal to said detonation charge in response to detection of passage from said tube.

2. A system as set forth in claim 1 wherein said control circuit is en electronic control circuit.

3. A system as set forth in claim 1 wherein said control circuit is characterised in remaining activated in response to said series of pulse generators generating pulse signals within a predetermined time frame and in becoming inactive in response to said pulse signals not being generated in said time frame to prevent delivery of said detonation signal to said detonation charge.

4. A system as set forth in claim 1 wherein said series of pulse generators generate at least one of a magnetic field, light, sound, pressure, electrical current, electromagnetic radiation, changes in gravity and radiation and said control circuit includes sensors responsive thereto.

5. A system as set forth in claim 1 further comprising a flame tower for expelling a gas stream therefrom and said tube extends to said gas stream.

6. A system for igniting discharges of inflammable fluids comprising a conducting tube;

a first pulse generator disposed along and externally of said tube;

a series of pulse generators disposed along and externally of said tube in spaced relation to said first pulse generator; and an ignition pallet for propulsion through said tube, said ignition pellet including a power source, a detonation charge and a control circuit, said control circuit being responsive to a pulse from said first pulse generator during travel of said ignition pellet through said tube upon passing said first pulse generator to turn "on" to receive power from said power source, said control circuit being responsive to a series of pulses from said series of pulse generators upon passing said series of pulse generators within a predetermined time period after passing said first pulse generator to remain "on" and to turn "off" in response to said series of pulses not being received within said time period, said control circuit being responsive to the presence of said tube after passing said series of pulse generators to remain "on", and said control circuit being responsive to the absence of said tube upon passing out of said tube to emit a detonating signal to said detonation charge.

* * * * *